United States Patent [19]

Petersen

[11] Patent Number: 4,573,885

[45] Date of Patent: Mar. 4, 1986

[54] PISTON DIAPHRAGM PUMP

[75] Inventor: Dirk Petersen, Norderstedt, Fed. Rep. of Germany

[73] Assignee: Bran & Lübbe GmbH, Norderstedt, Fed. Rep. of Germany

[21] Appl. No.: 723,624

[22] Filed: Apr. 15, 1985

[30] Foreign Application Priority Data

Apr. 13, 1984 [DE] Fed. Rep. of Germany ..... 3414006

[51] Int. Cl.[4] ..... F04B 43/06

[52] U.S. Cl. ..... 417/383; 417/386; 417/395; 92/98 R

[58] Field of Search ..... 417/383, 385, 386, 387, 417/388, 395; 92/97, 98 R, 103 SD, 98 D

[56] References Cited

U.S. PATENT DOCUMENTS

| | | | |
|---|---|---|---|
| 121,748 | 12/1871 | Blessing | 417/395 |
| 2,659,310 | 11/1953 | Ryba | 92/98 R X |
| 2,959,358 | 11/1960 | Vork | 417/395 X |
| 3,093,086 | 6/1963 | Altoz et al. | 417/395 X |
| 4,465,438 | 8/1984 | Brauer et al. | 417/386 |
| 4,466,339 | 8/1984 | Huddle | 417/395 X |

FOREIGN PATENT DOCUMENTS

| | | | |
|---|---|---|---|
| 2843054 | 4/1980 | Fed. Rep. of Germany | 417/383 |

*Primary Examiner*—Leonard E. Smith
*Attorney, Agent, or Firm*—Michael J. Striker

[57] ABSTRACT

In a piston diaphragm pump, comprising housing portions clamped together by clamping bolts, a diaphragm, sealingly clamped between adjacent housing portions for separating a feeding chamber from a working chamber, and a reciprocating piston acting in said working chamber filled with hydraulic medium for deflecting the diaphragm to change the volume of the feeding chamber, there is provided at least one supporting member to be screwed to a respective supporting thread in one of said housing portions so as to project towards another housing portion by a distance depending on its screwed position and to abut in the assembled position against an abutment surface on said other housing portion.

5 Claims, 1 Drawing Figure

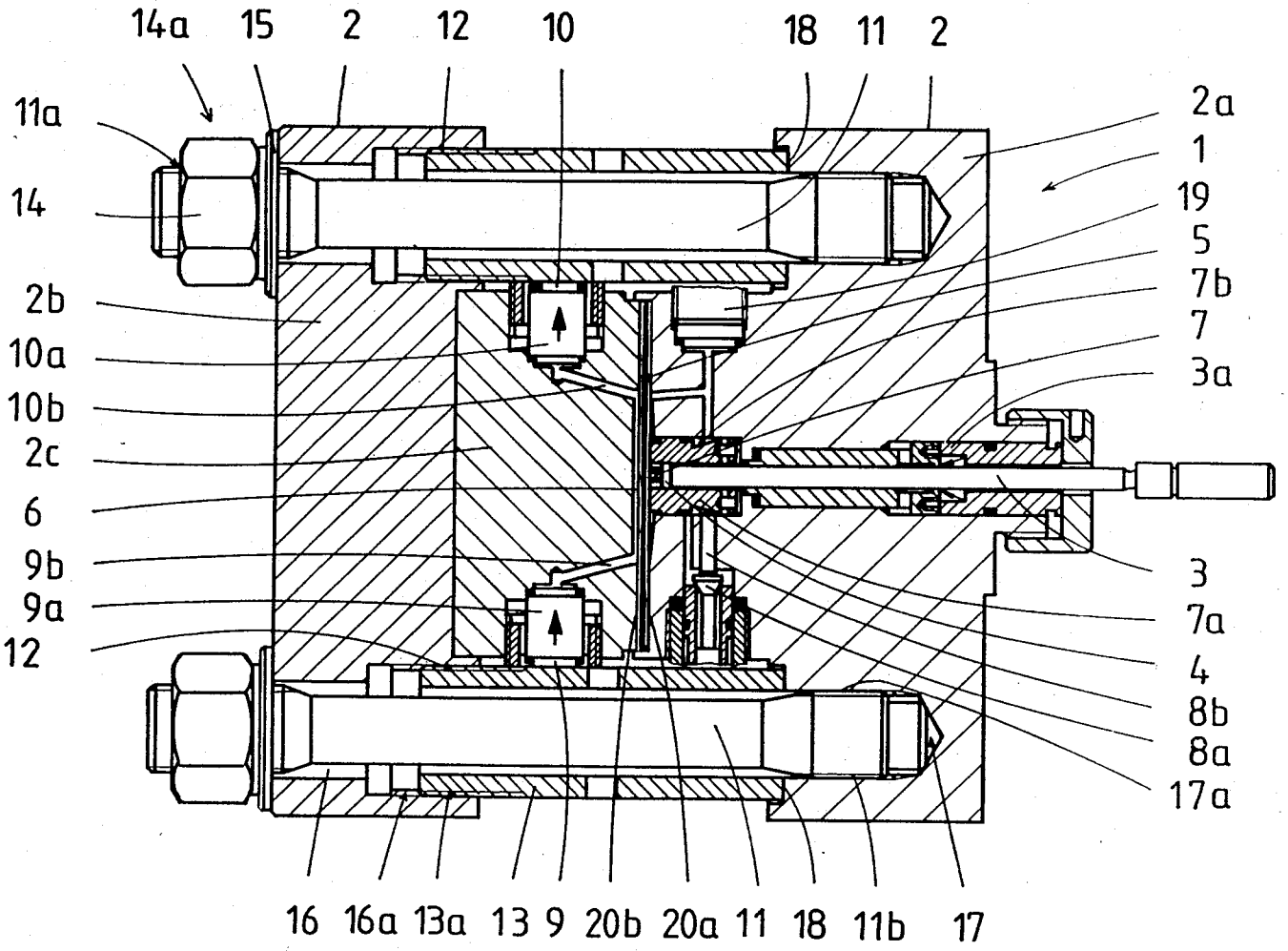
2a
1
19
5
7b
7
3a
3
7a
4
8b
8a
17a
2
11
18
10
12
2
15
14a
11a
14
2b
10a
10b
2c
6
9b
9a
12
17
11b
18
11
20a
20b
9
13
13a
16a
16

PISTON DIAPHRAGM PUMP

BACKGROUND OF THE INVENTION

The present invention relates to a piston diaphragm pump of the type comprising a housing made of several portions clamped to each other by bolts.

Piston diaphragm pumps for pumping a liquid medium, for example hydraulic oil, of the type under consideration include a housing, in which a feeding chamber, connected to a medium inlet and a medium outlet via respective valves, is provided, in which a diaphragm is sealingly clamped between at least two housing portions which are releasably connected to each other. The pump further includes a piston working chamber which in operation is filled with a hydraulic medium and in which a piston is reciprocally displaced for the generation of stroke deflections of the diaphragm, changing volumes of the feeding chamber. The housing portions are connected to each other by clamping bolts provided with threaded portions screwed in respective threads provided in the housing portions.

With conventional piston diaphragm pumps of the type under discussion the housing portions which enclose the diaphragm therebetween are clamped to each other by the clamping bolts wherein both the clamping force of the diaphragm and also a force intercepting the inner pressure exerted on a medium being pumped are provided by the torque applied to the nuts of the bolts externally of the pump housing. Thereby an overall minimal clamping force of each clamping bolt loads the diaphragm surface of the diaphragm clamped between the housing portions and this force is therefore limited by a highest permissible surface pressure. With such plastics as PTFE utilized for diaphragms operation pressures above 325 bar are not realizable in conventional pumps because the increase of the size of the clamping surface can not substantially reduce the surface pressure on the diaphragm.

For high pressures normally steel diaphragms are utilized, which can provide due to increased sensitivity only a short service life of the pumps. Dimensions of such pumps are substantially greater and the manufacture of the double diaphragm is much more expensive. The utilization of a position control with steel diaphragms is not possible.

SUMMARY OF THE INVENTION

It is an object of the present invention to provide an improved piston diaphragm pump.

It is another object of this invention to provide a piston diaphragm pump which would be able to operate at pressures above 400 bar with a diaphragm of plastics, and leakage-free.

These and other objects of the invention are attained by a piston diaphragm pump, comprising a housing having an inlet passage and an outlet passage and valves connected to said inlet and outlet passage, said housing having a feeding chamber connected to said inlet and outlet passage via said valves, said housing including housing portions releasably clamped to each other; at least one diaphragm sealingly clamped between said housing portions; a piston working chamber filled with a hydraulic medium in an operation position and separated from said feeding chamber by said diaphragm; a reciprocally displaceable piston in said working chamber and being operative to cause stroke deflections of said diaphragm so as to change volumes in said feeding chamber; a plurality of clamping bolts each connected to one of said housing portions and extending parallel to a direction of clamping of the housing portions to each other, each of said bolts having a threaded portion; and a plurality of clamping elements each provided with a thread tightened on a respective threaded portion of each bolt to draw said housing portions to each other, at least one of said housing portions being provided with at least one supporting thread which extends parallel to said direction of clamping; at least one supporting member to said supporting thread and projecting in an assembled position in the direction towards another of said housing portions by a distance corresponding to its screwed position; and said another housing portion having an abutment surface extended at right angles to said direction of clamping, said supporting member, upon being screwed outwardly relative to said supporting thread abutting against said abutment surface.

The piston diaphragm pump according to the invention permits one to use PTFE diaphragms and double diaphragms and utilize operation pressures of 500 bar without however exceeding surface pressures permissible for a diaphragm material. The force required for clamping the diaphragm between the housing portions and the force for an operational pressure can be precisely applied in the pump by accurately calculated torques on the clamping bolts.

The housing portions which clamp the diaphragm therebetween are more rigidly connected to each other than those in conventional pumps so that a bending deformation of the housing is very small and dimensions of the housing portions can be much smaller. Since a force fluctuation at operational pressure is smaller than that in conventional pumps service life of the clamping bolts as well as housing portions is substantially increased. The material of the diaphragm is less subjected to stresses; service life of the diaphragm is increased and a danger of obstruction by hydraulic liquid is reduced.

A plurality of said supporting members may be provided, each supporting member being a sleeve surrounding a respective clamping bolt.

Said another housing portion may have bores each having an inner thread, each clamping bolt having an end portion having an outer thread engaged with a respective inner thread, said one housing portion having through bores accommodating said bolts which extend via the through bores to the outside of said housing portion and are engaged there with said clamping elements, said clamping elements being clamping nuts, each of said through bores having portions provided with said supporting threads while each said sleeve may have an outer thread screwed in a respective supporting thread.

Each sleeve may have at least two even surface segments spaced from each other in a peripheral direction of the sleeve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing illustrates an axial sectional view through the piston diaphragm pump according to the invention.

DETAILED DESCRIPTION OF THE PREFERRED EMBODIMENTS

Referring now to the drawing in detail, the piston diaphragm pump generally designated by reference numeral 1 includes a three-part housing 2. Housing portions 2*a*, 2*b* and 2*c* are connected to each other by six clamping bolts 11 of which only two are shown in the drawing. Clamping bolts 11 each has at the end portion thereof an outer thread 11*b* which is screwed into an inner thread 17*a* of a pocket bore 17 provided in the housing portion 2*a*. Clamping bolts 11 extend via through bores 16 formed in the housing portion 2*b* in the direction parallel to the direction of clamping. Each clamping bolt 11 at its end opposite to thread 11*b* has an end threaded portion 11*a* on which a clamping nut 14, having an inner thread, is threaded with the interposition of a washer 15 between nut 14 and the end face of housing portion 2*b*.

Upon respective rotations of the clamping nuts 14 housing portions 2*a* and 2*b* are pulled towards each other. A third intermediate housing portion 2*c* is positioned between housing portions 2*a* and 2*b*. This intermediate housing portion has a feeding chamber 6 which is connected via bores 9*b*, 10*b* and valves 9*a*, 10*a* with an inlet passage 9 and an outlet passage 10, respectively. A double diaphragm 5 is medium-tightly clamped between the housing portion 2*c* and housing portion 2*a*. Diaphragm 5 separates the feeding chamber 6 from a piston working chamber 4 which under operation conditions is filled with a hydraulic medium. Diaphragm 5 is clamped between the housing portions 2*a* and 2*b* when the housing portions 2*a* and 2*b*, enclosing the intermediate portion 2*c*, are pulled together by tightening of the clamping nuts 14.

A piston 3 is reciprocally displaced in the piston working chamber 4. The movement of the piston generates respective stroke deflections of the diaphragm 4, these deflections changing volumes of the feeding chamber 6, and thereby cause the feeding of the medium. Depending on the design of the piston diaphragm pumps for very high pressures the feeding chamber 6 and the working chamber 4 can be made very small because great compression losses must be avoided.

A supporting plate 7 is arranged at the end of the working chamber 4 facing the diaphragm. Supporting plate 7 is slightly axially displaceable and cooperates with a spring-biased supporting element 7*a*. Supporting plate 7 prevents too great deflections of diaphragm 5 in the direction toward working chamber 4, which may cause a rupture of the diaphragm. If the pressure, at which the diaphragm 5 comes into contact with the supporting plate 7 exceeds the spring force, which urges the supporting element 7*a* in the direction of the feeding chamber 6, then the supporting element 7*a* together with the supporting plate 7 will be slightly displaced away from the feeding chamber 6 unless they come into contact with the housing portion 2*a*.

The supporting element 7*a* has an oblique surface 7*b* formed on the outer peripheral face thereof. This oblique surface is provded somewhat in the middle of the length of the supporting element so that the outer diameter of the supporting element 7*a* in the region of this oblique surface decreases in the direction to the feeding chamber 6. A bolt keeper 8*b* displaceable in the housing portion 2*a* is arranged in the slide contact with the oblique surface 7*b* of the supporting element; this bolt keeper is provided to prevent a filling-up valve 8*a* for a hydraulic medium from opening in the direction of the working chamber 4 when the supporting element 7*a* is in a normal operational position. When the supporting element 7*a* under the pressure of diaphragm 5 is moved away from the feeding chamber 6 the inwardly directed end of the bolt keeper 8*b* slides on the oblique surface 7*b* in the direction towards the working chamber 4 and makes possible a free movement of the valve body of the filling-up valve 8*a* in the same direction so that the amount of hydraulic medium lost due to leakage can be replaced with a new one. The filling-up valve is connected to a non-illustrated hydraulic medium supply container. A ventilation valve 19 is in communication with the working chamber 4 and serves the purpose of the removal of air contained in hydraulic oil. A non-shown overpressure valve serves for protecting the working chamber against a non-permissible high pressure.

Piston 3 is sealed against the escape of the hydraulic medium at very high pressures by means of a set of seals 3*a*.

Annular surfaces 20*a*, 20*b* of housing portions 2*a*, 2*c*, respectively, which surround the feeding chamber 6 may have in the exemplified embodiment a radial width of 30 mm; with the diameter of the feeding chamber of 60 mm a medium clamping diameter of the diaphragm 5 can be 90 mm. For an actual operation pressure of 500 bar the pump is construed for a maximal operation of 600 bar; the minimum screwing force $F_{SB}$ for such pressure as well as dimensions of the clamping bolts 11 can be calculated in accordance with AD-specification B7 of "Study group pressure tanks."

The above-mentioned minimum screwing force for the operation condition $F_{SB}$ is obtained for the given clamping dimensions and PTFE as diaphragm material to be 1,053,502N; M30-clamping bolts have a shaft diameter of 23 mm. To obtain the minimum clamping force $F_{SB}$ per each clamping bolt a torque M2 of 721.5 Nm is applied. Without the features of the present invention the surface pressure of the diaphragm 5 between annular surfaces 20*a*, 20*b* would be 124.2 $N/mm^2$ whereby the highest permissible surface pressure of the diaphragm material would be appreciably exceeded.

That component of the minimum screwing force $F_{SB}$ to intercept only the inner pressure $F_i$ is taken up according to the invention by supporting members 13 which are mounted between the outer housing portions 2*a* and 2*b* so that the diaphragm 5 is loaded between annular surfaces 20*a* and 20*b* only with a component $F_{DB}$ of the minimum screwing force $F_{SB}$ which is required for a preliminary deforming and clamping of the diaphragm 5.

Through bores 16 formed in the housing portion 2*b* have further portions of enlarged diameter 16*a*, which are provided with inner threads 12. Supporting members 13 are formed in the exemplified embodiment as sleeves 13 surrounding respective clamping bolts 11 and have respective outer threads 13*a* screwed in inner thread 12. The housing portion 2*a* has a supporting or abutment surface 18 which in assembly abuts against the end face of each supporting sleeve 13 and extends perpendicularly to the direcion of clamping. Each supporting sleeve 13 has at least two flat surface segments, spaced from each other in the peripheral direction and which serve for the application of a tool for the rotation of the supporting sleeves 13.

During the assembling of the piston diaphragm pump the supporting sleeves 13 are screwed into threads 12 so far that the end portion of each sleeve is first sufficiently spaced from the abutment surface 18. Then the clamping nuts 14 of bolts 11 are tightened further so that force $F_{DB}$ required for a preliminary deforming and clamping of the diaphragm between annular surfaces 20*a* and 20*b* acts on the diaphragm and the latter is protected against distortion and leakage. In the exemplified embodiment surface pressure $p^i$ can be 79.19 N/mm$^2$, which can be obtained by applying to clamping nuts 14 a torque of 460 Nm. Then clamping sleeves 13 are rotated in the unscrewing direction relative to threads 12 and are moved thereby in the direction towards housing portion 2*a* unless they come into contact in the force-locking fashion with the abutment surface 18. Inasmuch as the outer housing portions 2*a* and 2*b*, due to the abutment of the end faces of sleeves 13 against surface 18 and also due to the thread engagement 13*a* and 12, are prevented from a further movement towards each other, now the total torque required for a minimum clamping force in the operational condition $F_{SB}$ of 721.5 Nm can be applied to the clamping nuts 14 without having the pressure on the diaphragm 5 between annular surfaces 20*a* and 20*b* to increase further. A preliminary deforming force $F_{DB}$ can thus be applied to the clamping surface of the diaphragm 5 independently from the required minimum clamping force $F_{SB}$.

A piston diaphragm pump with a PTFE-double diaphragm of this invention has been tested for 1000 hours at operation pressure of 500 bar; no damage to the diaphragm and no leakage have occurred during the test.

It is of course understood that piston diaphragm pumps with steel diaphrams may be employed whereas a substantially more rigid clamping of the housing portions of the pump to each other, as compared to conventional pumps of the foregoing type, can be attained.

It will be understood that each of the elements described above, or two or more together, may also find a useful application in other types of piston diaphragm pumps differing from the types described above.

While the invention has been illustrated and described as embodied in a piston diaphragm pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a piston diaphragm pump, comprising a housing having an inlet passage and an outlet passage; valves connected to said inlet and outlet passage, said housing having a feeding chamber connected to said inlet and outlet passage via said valves, said housing including housing portions releasably clamped to each other; at least one diaphragm sealingly clamped between said housing portions; a piston working chamber filled with a hydraulic medium in an operation position and separated from said feeding chamber by said diaphragm; a reciprocally displaceable piston in said working chamber and being operative to cause stroke deflections of said diaphragm so as to change volumes of said feeding chamber; a plurality of clamping bolts each connected to one of said housing portions and extending parallel to a direction of clamping of the housing portions to each other, each of said bolts having a threaded portion; and a plurality of clamping elements each provided with a thread tightened on a respective threaded portion of each bolt to draw said housing portions to each other, the improvement comprising:

(a) at least one of said housing portions being provided with at least one supporting thread which extends parallel to said direction of clamping;

(b) at least one supporting member to be screwed to said supporting thread and projecting in an assembled position in the direction towards another of said housing portions by a distance corresponding to its screwed position; and (c) said another housing portion having an abutment surface extended at right angles to said direction of clamping, said supporting member upon being screwed outwardly relative to said supporting thread abutting against said abutment surface.

2. The pump as defined in claim 1, wherein a plurality of said supporting members are provided, each supporting member being a sleeve surrounding a respective clamping bolt.

3. The pump as defined in claim 2, wherein said another housing portion has bores each having an inner thread, each clamping bolt having an end portion having an outer thread engaged with a respective inner thread, said one housing portion having through bores accommodating said bolts which extend via the through bores to the outside of said housing portion and are engaged there with said clamping elements, said clamping elements being clamping nuts, each of said through bores having portions provided with said supporting threads while each said sleeve having an outer thread screwed in a respective supporting thread.

4. The pump as defined in claim 3, wherein each sleeve has at least two even surface segments spaced from each other in a peripheral direction of the sleeve.

5. The pump as defined in claim 3, wherein two end housing portions and one intermediate housing portion are provided, said feeding chamber being formed between one of said end portions and said intermediate portion.

* * * * *